US011208286B2

(12) United States Patent
Morita

(10) Patent No.: US 11,208,286 B2
(45) Date of Patent: Dec. 28, 2021

(54) SHEET DISCHARGE DEVICE WITH COOLING MECHANISM, IMAGE FORMING APPARATUS

(71) Applicant: KYOCERA Document Solutions Inc., Osaka (JP)

(72) Inventor: Takahito Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 107 days.

(21) Appl. No.: 16/725,743

(22) Filed: Dec. 23, 2019

(65) Prior Publication Data

US 2020/0223652 A1 Jul. 16, 2020

(30) Foreign Application Priority Data

Jan. 15, 2019 (JP) ..... JP2019-004065

(51) Int. Cl.
*B65H 29/24* (2006.01)
*B65H 29/14* (2006.01)
*G03G 21/20* (2006.01)

(52) U.S. Cl.
CPC ..... *B65H 29/247* (2013.01); *B65H 29/14* (2013.01); *G03G 21/206* (2013.01); *B65H 2301/5144* (2013.01); *B65H 2301/5305* (2013.01); *B65H 2406/121* (2013.01); *B65H 2515/40* (2013.01); *B65H 2801/27* (2013.01)

(58) Field of Classification Search
CPC .... B65H 29/24; B65H 29/245; B65H 29/246; B65H 29/247; B65H 29/248; B65H 2301/5144; G03G 21/206; G03G 15/2021; G03G 15/2017
See application file for complete search history.

(56) References Cited

U.S. PATENT DOCUMENTS 10,241,452 B2 * 3/2019 Yamashita ..... G03G 15/2064
2014/0029999 A1 * 1/2014 Masuta ..... B65H 31/02 399/405
2016/0185552 A1 * 6/2016 Hoshino ..... G03G 15/6552 271/211
2020/0218181 A1 * 7/2020 Midorikawa ..... G03G 15/2021

FOREIGN PATENT DOCUMENTS

JP 2010266799 A 11/2010

* cited by examiner

*Primary Examiner* — Jeremy R Severson
(74) *Attorney, Agent, or Firm* — Alleman Hall Creasman & Tuttle LLP

(57) ABSTRACT

A sheet discharge device includes a discharge conveyance path, a pair of discharge rollers, a side wall, a sheet stacking tray, a first fan, and a second fan. The discharge conveyance path communicates with a discharge port through which a sheet having passed through a fixing portion is discharged. The pair of discharge rollers convey the sheet along the discharge conveyance path and discharge the sheet from the discharge port. The side wall extends downward from the discharge port. The sheet stacking tray extends from the side wall in a sheet discharge direction in which the sheet is discharged by the pair of discharge rollers. The first fan is disposed below the discharge conveyance path and blows air toward the discharge conveyance path. The second fan is disposed above the discharge port and blows air from above the discharge port toward the sheet stacking tray.

6 Claims, 5 Drawing Sheets

SHEET DISCHARGE DEVICE WITH COOLING MECHANISM, IMAGE FORMING APPARATUS

INCORPORATION BY REFERENCE

This application is based upon and claims the benefit of priority from the corresponding Japanese Patent Application No. 2019-004065 filed on Jan. 15, 2019, the entire contents of which are incorporated herein by reference.

BACKGROUND

The present disclosure relates to: a sheet discharge device for discharging sheets with images formed thereon; and an image forming apparatus including a sheet discharge device.

An image forming apparatus, such as a printer, for forming an image by an electrophotographic method includes a fixing device. The fixing device heats a sheet on which a toner image has been transferred, to fix the toner image to the sheet. The sheet heated by the fixing device is discharged from a discharge port and stacked on a sheet stacking portion.

In this type of image forming apparatus, a sheet may be stacked on the sheet stacking portion before toner on the sheet that has been melted by the heating is completely solidified, causing the sheet to be stuck to another sheet on the sheet stacking portion. As a related technology handling this problem, there is known a sheet discharge device in which air is blown to a surface of a sheet that has been conveyed from the fixing device to the discharge port, and the air blown to the sheet is guided to the sheet stacking portion. In this related technology, both the sheet and the sheet stacking portion are cooled.

SUMMARY

A sheet discharge device according to an aspect of the present disclosure includes a discharge conveyance path, a pair of discharge rollers, a side wall, a sheet stacking tray, a first fan, and a second fan. The discharge conveyance path communicates with a discharge port through which a sheet having passed through a fixing portion is discharged, the sheet having a toner image transferred thereon and heated in the fixing portion. The pair of discharge rollers convey the sheet along the discharge conveyance path and discharge the sheet from the discharge port. The side wall extends downward from the discharge port. The sheet stacking tray extends from the side wall in a sheet discharge direction in which the sheet is discharged by the pair of discharge rollers. The sheet stacking tray allows the sheet discharged from the discharge port to be stacked thereon. The first fan is disposed below the discharge conveyance path and blows air toward the discharge conveyance path. The second fan is disposed above the discharge port and blows air from above the discharge port toward the sheet stacking tray.

An image forming apparatus according to another aspect of the present disclosure includes a housing, the sheet discharge device, a sheet supply portion, an image forming portion, and the fixing portion. The sheet supply portion supplies a sheet. The image forming portion is located in the housing and forms a toner image on the sheet supplied from the sheet supply portion. The fixing portion is located upstream of the sheet discharge device in the housing.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

Figure 1:
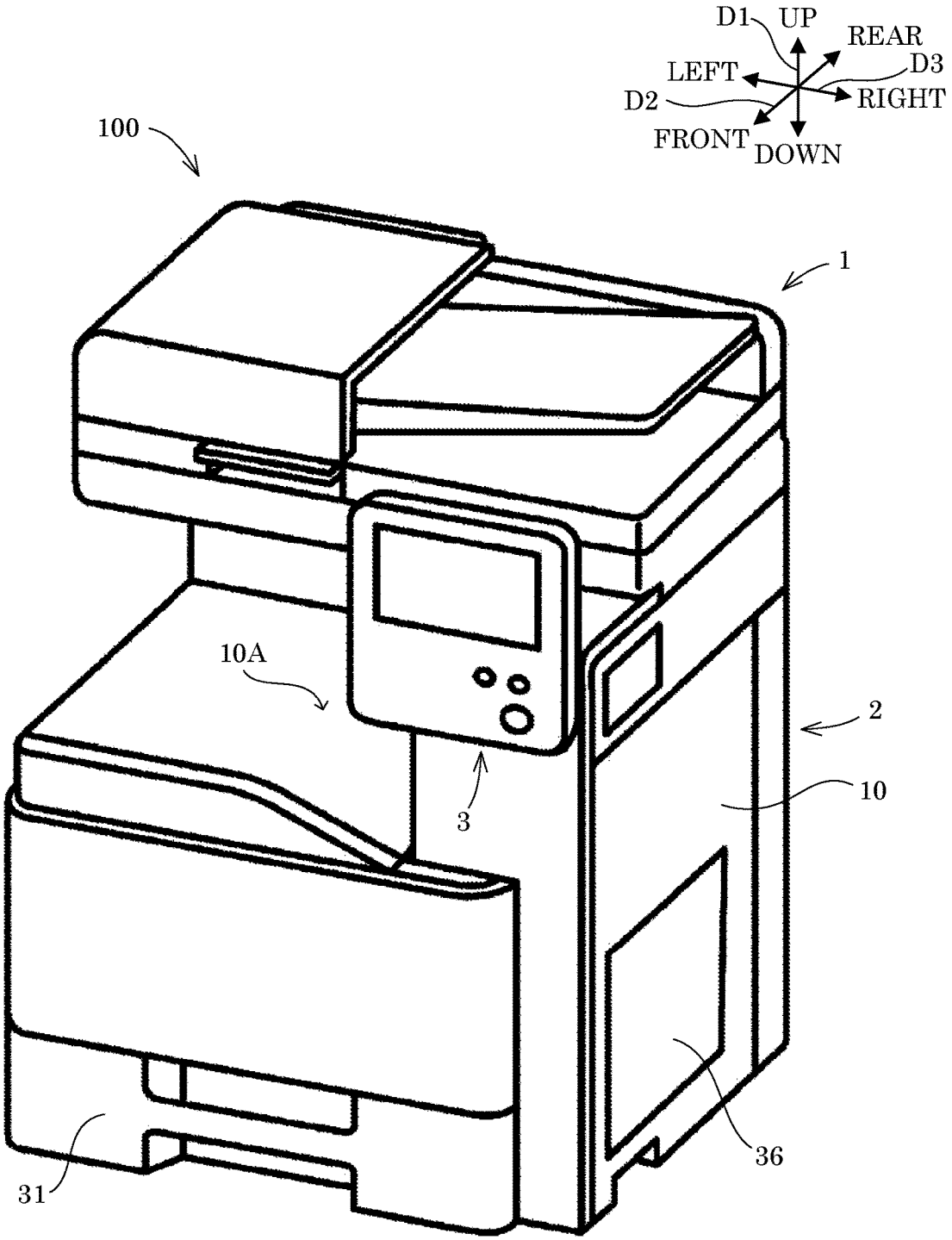
FIG. 1 is a perspective diagram showing a configuration of an image forming apparatus according to an embodiment of the present disclosure.

First, a description is given of a configuration of an image forming apparatus 100 according to an embodiment of the present disclosure with reference to FIG. 1.

For the sake of explanation, an up-down direction D1 is defined as a vertical direction in a state where the image forming apparatus 100 is installed usably (the state shown in FIG. 1). In addition, a front-rear direction D2 is defined on the supposition that a left-near side of the image forming apparatus 100 shown in FIG. 1 is a front side (front). Furthermore, a left-right direction D3 is defined based on the image forming apparatus 100 in the installation state viewed from the front side.

The image forming apparatus 100 is a multifunction peripheral having a plurality of functions such as a scan function for reading image data from a document sheet, a print function for forming an image based on image data, a facsimile function, and a copy function. It is noted that the present disclosure is applicable to image forming apparatuses such as a printer device, a facsimile device, and a copier.

As shown in FIG. 1, the image forming apparatus 100 includes an image reading portion 1, a print portion 2, and an operation/display portion 3.

The image reading portion 1 includes an automatic document feeder (ADF) for conveying a document sheet placed on a document sheet placing portion to a sheet discharge portion. The image reading portion 1 also includes a document sheet table on which a document sheet is placed. The image reading portion 1 is configured to read image data from a document sheet conveyed by the automatic document feeder, or from a document sheet placed on the document sheet table.

The print portion 2 is configured to form an image on a sheet by an electrophotographic method based on image data read by the image reading portion 1. In addition, the print portion 2 is configured to form an image on a sheet based on image data input from an external information processing apparatus.

The operation/display portion 3 includes a display portion that is, for example, a liquid crystal display and displays various types of information in response to control instructions from a control portion (not shown). The operation/display portion 3 also includes an operation portion that is composed of, for example, operation keys or a touch panel through which various types of information are input to the control portion in response to user operations. The operation/display portion 3 is pivotably supported by a housing 10 of the print portion 2 (see FIG. 1 and FIG. 4).

[Configuration of Print Portion 2]

Next, a configuration of the print portion 2 is described with reference to FIG. 1 and FIG. 2. Here, FIG. 2 is a cross-sectional diagram taken along a plane that is perpendicular to the front-rear direction D2 and passes the center of the housing 10 in the front-rear direction D2.

Figure 2:
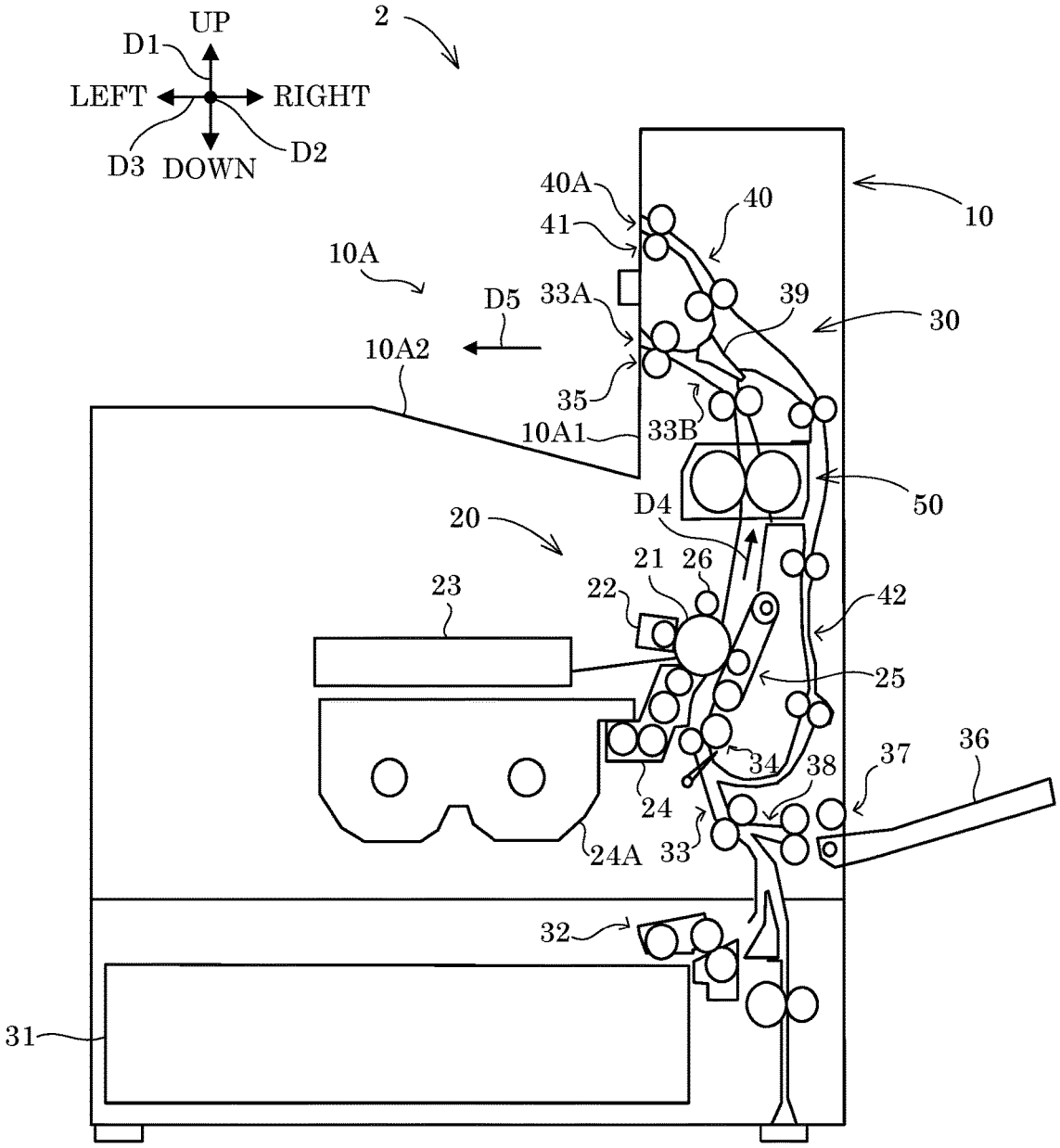
FIG. 2 is a cross-sectional diagram showing a configuration of an image forming portion of the image forming apparatus according to the embodiment of the present disclosure.

As shown in FIG. 1 and FIG. 2, the print portion 2 includes the housing 10, an image forming portion 20, a sheet conveyance portion 30, and a fixing portion 50.

The housing 10 stores components of the print portion 2. The housing 10 is formed in an approximate shape of a rectangular parallelepiped. As shown in FIG. 1 and FIG. 2, a sheet receiving portion 10A is formed in an upper portion of the housing 10. A sheet with an image formed thereon by the print portion 2 is stacked on the sheet receiving portion 10A.

The image forming portion 20 forms a toner image on a sheet conveyed by the sheet conveyance portion 30. As shown in FIG. 2, the image forming portion 20 includes a photoconductor drum 21, a charging device 22, a laser scanning unit 23, a developing device 24, a toner container 24A, a transfer device 25, and a cleaning member 26.

An electrostatic latent image is formed on a surface of the photoconductor drum 21. The charging device 22 electrically charges the surface of the photoconductor drum 21. The laser scanning unit 23 forms the electrostatic latent image on the surface of the photoconductor drum 21. The developing device 24 develops, with toner, the electrostatic latent image formed on the surface of the photoconductor drum 21. The toner container 24A supplies toner to the developing device 24. The transfer device 25 transfers the toner image formed on the photoconductor drum 21, to a sheet conveyed by the sheet conveyance portion 30. The cleaning member 26 cleans the surface of the photoconductor drum 21 after the toner image is transferred therefrom by the transfer device 25.

The sheet conveyance portion 30 conveys the sheet in a path that passes through the image forming portion 20 and the fixing portion 50. As shown in FIG. 1 and FIG. 2, the sheet conveyance portion 30 includes a sheet feed cassette 31, a first sheet feed unit 32 (an example of a sheet feed portion of the present disclosure), a first conveyance path 33, a pair of registration rollers 34, a pair of first discharge rollers 35 (an example of a pair of discharge rollers of the present disclosure), a manual feed tray 36, a second sheet feed unit 37, a second conveyance path 38, a switch member 39, a third conveyance path 40, a pair of second discharge rollers 41, and a fourth conveyance path 42.

The sheet feed cassette 31 stores sheets on which images are to be formed by the print portion 2. As shown in FIG. 1 and FIG. 2, the sheet feed cassette 31 is provided in a bottom portion of the housing 10. For example, the sheets stored in the sheet feed cassette 31 are sheet-like materials such as sheets of paper, sheets of coated paper, postcards, envelopes, and OHP sheets. The sheet feed cassette 31 includes a lift plate (not shown) for lifting a plurality of sheets stored therein.

The first sheet feed unit 32 feeds the sheets stored in the sheet feed cassette 31 one by one to the first conveyance path 33. The first sheet feed unit 32 includes a pickup roller, a sheet feed roller, and a retard roller. The pickup roller feeds a top sheet among the plurality of sheets lifted by the lift plate of the sheet feed cassette 31, to the sheet feed roller by rotating while in contact with an upper surface of the top sheet. The sheet feed roller feeds the sheet fed by the pickup roller to the first conveyance path 33 by rotating while in contact with the upper surface of the sheet. The retard roller is disposed below the sheet feed roller and biased toward the sheet feed roller. When a plurality of overlapping sheets are fed by the pickup roller, the retard roller separates sheets other than the top sheet from the plurality of overlapping sheets.

The first conveyance path 33 is a path in which a sheet moves from the sheet feed cassette 31 to a discharge port 33A. As shown in FIG. 2, the first conveyance path 33 extends in the up-down direction D1. A plurality of conveyance rollers including the pair of registration rollers 34 and the pair of first discharge rollers 35 are provided in the first conveyance path 33. In addition, the transfer device 25 and the fixing portion 50 are provided in the first conveyance path 33. In the first conveyance path 33, a sheet fed from the sheet feed cassette 31 by the first sheet feed unit 32 is conveyed in a conveyance direction D4 (see FIG. 2) toward the discharge port 33A. The first conveyance path 33 is formed by a pair of conveyance guide members provided in the housing 10.

The pair of registration rollers 34 convey the sheet such that the sheet reaches a transfer position at the same timing when a toner image formed on the surface of the photoconductor drum 21 and carried thereby reaches the transfer position, and the transfer device 25 transfers the toner image to the sheet at the transfer position.

The pair of first discharge rollers 35 are provided in a partial conveyance path 33B (an example of a discharge conveyance path of the present disclosure) that is a section of the first conveyance path 33 and extends from the fixing portion 50 to the discharge port 33A. The pair of first discharge rollers 35 convey, along the partial conveyance path 33B, the sheet that has passed through the fixing portion 50, and discharge the sheet from the discharge port 33A. The pair of first discharge rollers 35 include an upper discharge roller 35A (see FIG. 3) and a lower discharge roller 35B (see FIG. 3), wherein the upper discharge roller 35A is disposed at an upper position, and the lower discharge roller 35B is disposed at a lower position.

As shown in FIG. 2, the sheet receiving portion 10A includes a side wall 10A1 and a sheet stacking tray 10A2, wherein the side wall 10A1 extends downward from the discharge port 33A, and the sheet stacking tray 10A2 extends from the side wall 10A1 in a sheet discharge direction D5 in which the sheet is discharged by the pair of first discharge rollers 35. The sheet discharged from the discharge port 33A by the pair of first discharge rollers 35 is stacked on the sheet stacking tray 10A2 of the sheet receiving portion 10A.

Sheets on which images are to be formed by the print portion 2 are placed on the manual feed tray 36. As shown in FIG. 1 and FIG. 2, the manual feed tray 36 is provided at the right side of the housing 10. The manual feed tray 36 includes a lift plate (not shown) for lifting a plurality of sheets placed thereon.

The second sheet feed unit 37 feeds the sheets placed on the manual feed tray 36 one by one to the second conveyance path 38. The second sheet feed unit 37 has a similar configuration to the first sheet feed unit 32.

The second conveyance path 38 is a path in which a sheet moves. The second conveyance path 38 extends from the manual feed tray 36 to a position in the first conveyance path 33 that is on the upstream side of the pair of registration rollers 34 in the conveyance direction D4. In the second conveyance path 38, a sheet fed from the manual feed tray 36 by the second sheet feed unit 37 is conveyed toward the first conveyance path 33. The second conveyance path 38 is formed by a pair of conveyance guide members provided in the housing 10.

The switch member 39 is provided in such a way as to change its attitude between a first attitude (the attitude shown in FIG. 2) and a second attitude, wherein the switch member 39 at the first attitude opens the first conveyance path 33 and closes the third conveyance path 40, and the switch member 39 at the second attitude opens the third conveyance path 40 and closes the first conveyance path 33. The switch member 39 is pivotably provided in the first conveyance path 33. The switch member 39 pivots upon receiving a driving force supplied from a drive source (not shown). This allows the switch member 39 to change its attitude between the first attitude and the second attitude.

The third conveyance path 40 is a path in which a sheet moves. The third conveyance path 40 extends from the partial conveyance path 33B to a discharge port 40A that is provided above the discharge port 33A. The pair of second discharge rollers 41 are provided in the third conveyance path 40. The third conveyance path 40 is formed by a pair of conveyance guide members provided in the housing 10. The third conveyance path 40 is used to convey a sheet to a post-processing device that is attached to the image forming apparatus 100.

The pair of second discharge rollers 41 convey, along the third conveyance path 40, the sheet that has passed through the fixing portion 50, and discharge the sheet from the discharge port 40A.

The fourth conveyance path 42 is a path in which a sheet moves. The fourth conveyance path 42 extends from the partial conveyance path 33B to a position in the first conveyance path 33 that is on the upstream side of the pair of registration rollers 34 in the conveyance direction D4. A plurality of conveyance rollers are provided in the fourth conveyance path 42. The fourth conveyance path 42 is formed by a pair of conveyance guide members provided in the housing 10. The fourth conveyance path 42 is used to reverse a sheet to perform double-side printing.

The fixing portion 50 heats a sheet on which a toner image has been transferred by the transfer device 25, to fix the toner image to the sheet.

Meanwhile, a sheet may be stacked on the sheet receiving portion 10A before toner on the sheet that has been melted by the heating is completely solidified, causing the sheet to be stuck to another sheet on the sheet receiving portion 10A. As a related technology handling this problem, there is known a sheet discharge device in which air is blown to a surface of a sheet conveyed from the fixing portion 50 to the discharge port 33A, and the air blown to the sheet is guided to the sheet receiving portion 10A. In this related technology, both the sheet and the sheet receiving portion 10A are cooled.

However, according to the above-mentioned sheet discharge device of the related technology, the air blown to the surface of the sheet is used to cool the sheet receiving portion 10A. Thus the sheet receiving portion 10A is insufficiently cooled, and sheets may not be prevented from sticking together.

On the other hand, according to the image forming apparatus 100 of the present embodiment, as described below, it is possible to prevent sheets with toner images fixed thereto from sticking together.

Figure 3:
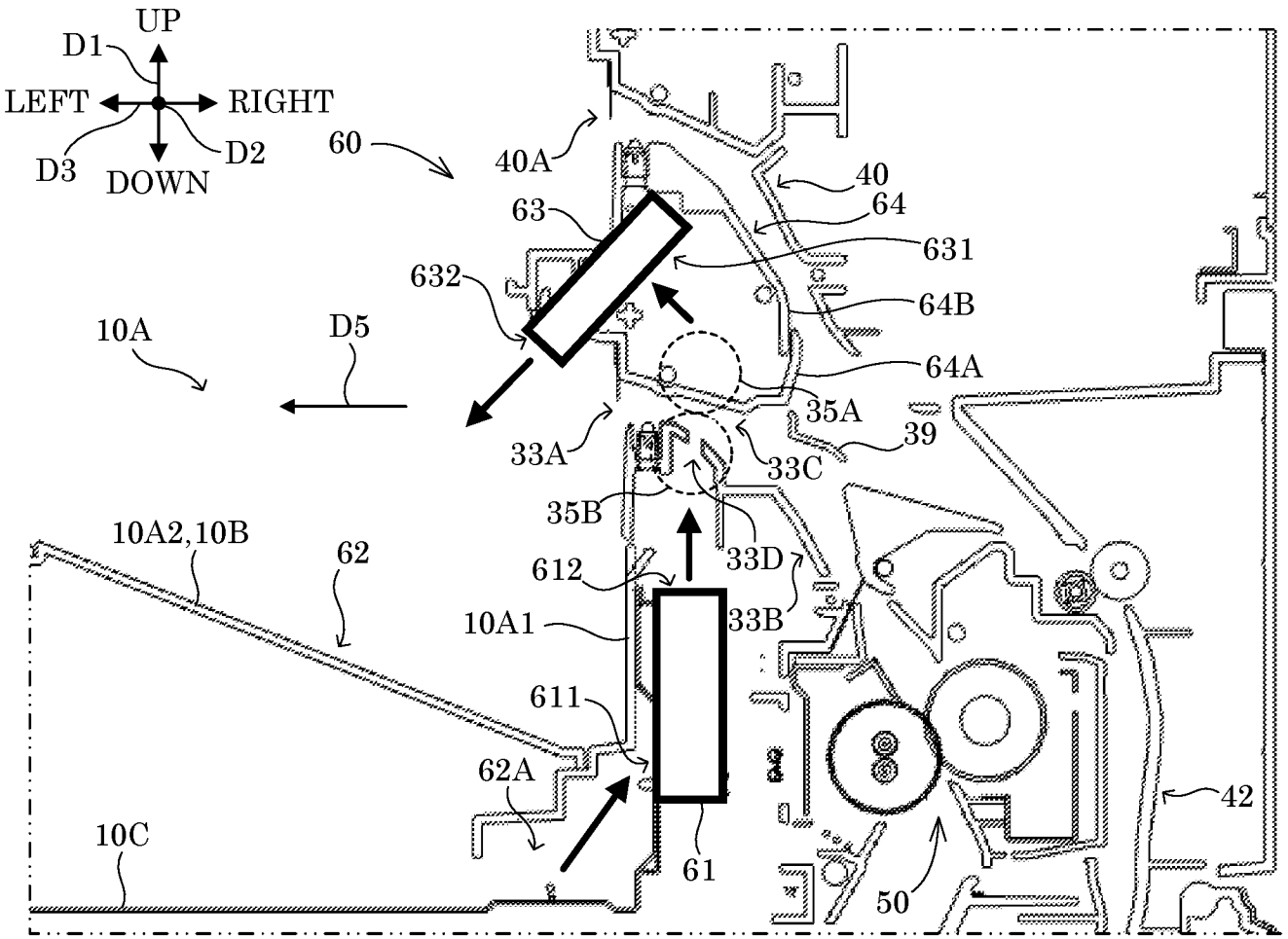
FIG. 3 is a cross-sectional diagram showing a configuration of a cooling portion of the image forming apparatus according to the embodiment of the present disclosure.

Specifically, the print portion 2 includes a cooling portion 60 shown in FIG. 3.

[Configuration of Cooling Portion 60]

Figure 4:
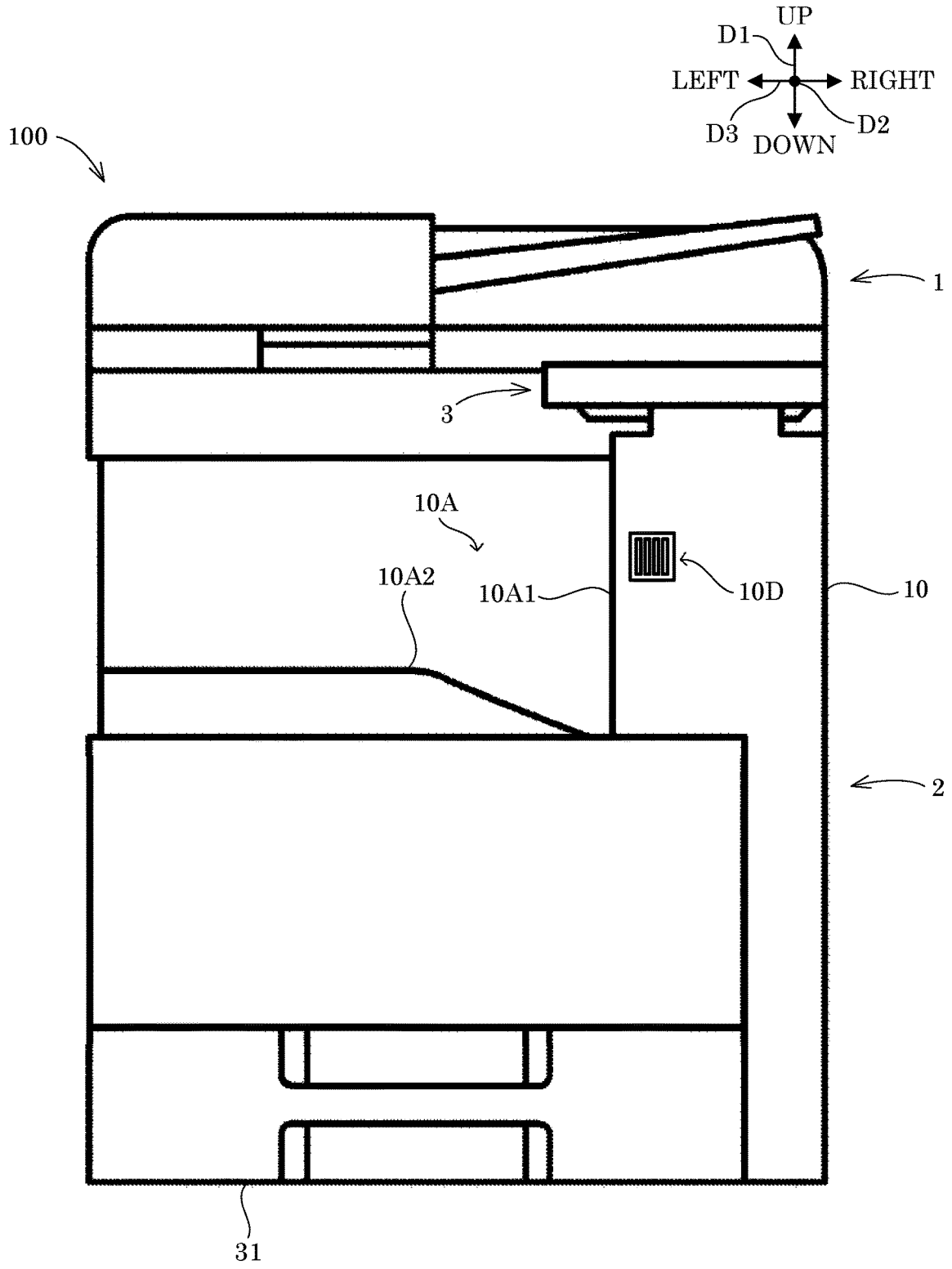
FIG. 4 is a front diagram showing a configuration of the image forming apparatus according to the embodiment of the present disclosure.
Figure 5:
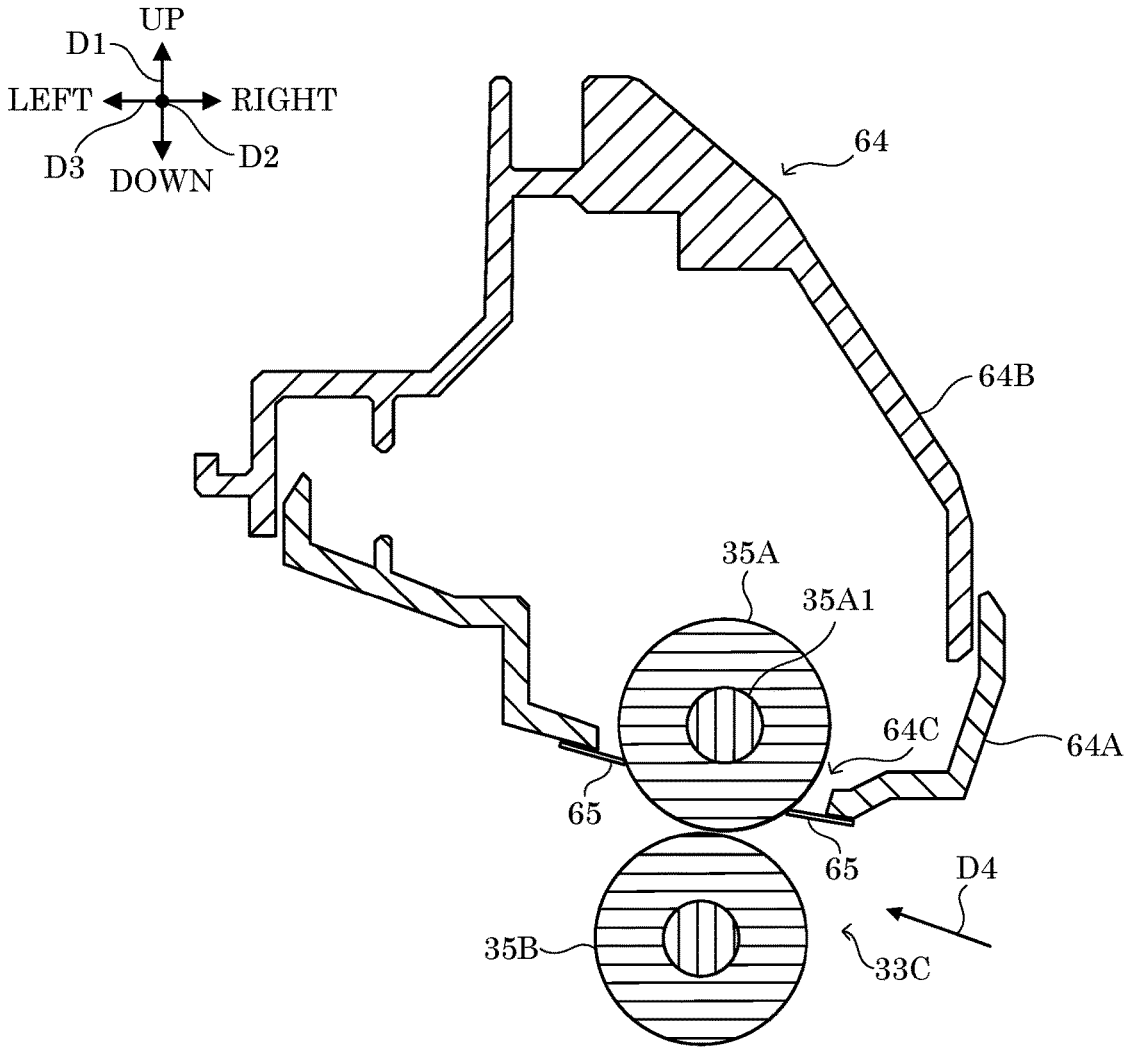
FIG. 5 is a cross-sectional diagram showing a configuration of a duct of the image forming apparatus according to the embodiment of the present disclosure.

The following describes a configuration of the cooling portion 60 with reference to FIG. 2 to FIG. 5. Here, FIG. 3 is a cross-sectional diagram of a periphery of the partial conveyance path 33B in the housing 10 taken along a plane that is perpendicular to the front-rear direction D2 and passes a portion of the housing 10 on the rear side of the center of the housing 10 in the front-rear direction D2. In FIG. 3, the pair of first discharge rollers 35 are indicated by the dotted line. FIG. 4 is a front diagram showing the image forming apparatus 100 in a state of having pivoted to an attitude where the operation/display portion 3 faces upward. FIG. 5 is a cross-sectional diagram of a duct 64 taken along a plane that is perpendicular to the front-rear direction D2 and passes the center of the housing 10 in the front-rear direction D2.

The cooling portion 60 blows air to a sheet conveyed in the partial conveyance path 33B, and blows air to the sheet receiving portion 10A. As shown in FIG. 3 to FIG. 5, the cooling portion 60 includes two first sirocco fans 61 (an example of a first fan of the present disclosure), an air supply portion 62, two second sirocco fans 63 (an example of a second fan of the present disclosure), the duct 64, and a seal member 65. Here, a device including: the housing 10; the pair of first discharge rollers 35 of the sheet conveyance portion 30; and the cooling portion 60 is an example of a sheet discharge device of the present disclosure.

The two first sirocco fans 61 are disposed, in alignment in the front-rear direction D2, below a discharge-near portion 33C (see FIG. 3) that is a portion of the partial conveyance path 33B close to the discharge port 33A. For example, the two first sirocco fans 61 are provided on both sides of the center of the housing 10 in the front-rear direction D2. The first sirocco fans 61 blow air from below the discharge-near portion 33C toward the discharge-near portion 33C.

Here, the discharge-near portion 33C is closer to the discharge port 33A than the fixing portion 50 of the partial conveyance path 33B. In other words, the discharge-near portion 33C is closer to the discharge port 33A than an intermediate portion of the partial conveyance path 33B between the fixing portion 50 and the discharge port 33A. Specifically, in the image forming apparatus 100, the discharge-near portion 33C is a portion of the partial conveyance path 33B in which the pair of first discharge rollers 35 are disposed. A conveyance surface, namely a lower surface of the discharge-near portion 33C has two slits 33D (an example of a communication port of the present disclosure) through which air blown from the two first sirocco fans 61 moves. It is noted that the discharge-near portion 33C may be on the upstream side or the downstream side, in the conveyance direction D4 (see FIG. 2), of a portion of the partial conveyance path 33B in which the pair of first discharge rollers 35 are disposed.

The first sirocco fans 61 each have a flat cylindrical shape extending in the left-right direction D3, and each have a first air intake port 611 in the left side. The first air intake ports 611 face the sheet receiving portion 10A and communicate with the air supply portion 62 via a ventilation path 62A (see FIG. 3) that is formed below the side wall 10A1. In addition, each of the first sirocco fans 61 includes a first air exhaust port 612 that is opened upward at an upper position of an outer circumferential surface thereof.

When the first sirocco fans 61 are driven by power supplied from a power source (not shown), air is taken from the air supply portion 62 into the first sirocco fans 61 through the first air intake ports 611. In addition, the air taken into the first sirocco fans 61 is blown out upward through the first air exhaust ports 612. The air blown out through the first air exhaust ports 612 of the first sirocco fans 61 passes through the slits 33D and cools the discharge-near portion 33C and a lower surface of a sheet that passes through the discharge-near portion 33C. Here, the air blown out from the first sirocco fans 61 is blown to the discharge-near portion 33C that is a portion of the partial conveyance path 33B close to the discharge port 33A. As a result, compared to a configuration where the air is blown to a portion close to the fixing portion 50, a temperature reduction in the fixing portion 50 is restricted. It is noted that in FIG. 3, an air movement path of air that flows from the air supply portion 62 to the first air intake ports 611 of the first sirocco fans 61, and an air movement path of air blown out from the first air exhaust ports 612 of the first sirocco fans 61, are indicated by a thick arrow line.

It is noted that the number of the first sirocco fans 61 and the slits 33D may be one or three or more.

The air supply portion 62 is provided to extend in the left-right direction D3 below the sheet receiving portion 10A. The air supply portion 62 forms a space for storing air supplied from the first sirocco fans 61. The air supply portion 62 communicates with the first air intake ports 611 of the first sirocco fans 61 via the ventilation path 62A.

For example, the air supply portion 62 is composed of an exterior member 10B (see FIG. 3), an exterior member (not shown), and a sheet metal member 10C, wherein the exterior member 10B forms a part of an upper surface of the housing 10 and serves as the sheet receiving portion 10A, the exterior member (not shown) forms opposite surfaces of the housing 10 in the front-rear direction D2, and the sheet metal member 10C forms an upper surface of an inner frame that is provided in the housing 10. It is noted that the air supply portion 62 may be a duct that is provided to extend in the left-right direction D3 to communicate with an air intake port formed in an outer surface of the housing 10, and to the first air intake ports 611 of the first sirocco fans 61.

The two second sirocco fans 63 are disposed in alignment in the front-rear direction D2 above the discharge port 33A. For example, the two second sirocco fans 63 are provided on both sides of the center of the housing 10 in the front-rear direction D2. The second sirocco fans 63 take in air from the duct 64, and blow the air above the discharge port 33A toward the sheet stack tray 10A2.

The second sirocco fans 63 each have a flat cylindrical shape extending from right below to left above, and each have a second air intake port 631 in the right below side. The second air intake ports 631 face the duct 64 and communicate with the duct 64. Each of the second sirocco fans 63 includes a second air exhaust port 632 that is opened at an outer circumferential surface thereof toward the sheet stacking tray 10A2. The second air exhaust ports 632 are exposed to outside the housing 10.

When the second sirocco fans 63 are driven by power supplied from a power source (not shown), air is taken from the duct 64 into the second sirocco fans 63 through the second air intake ports 631. In addition, the air taken into the second sirocco fans 63 is blown out toward the sheet stacking tray 10A2 of the sheet receiving portion 10A through the second air exhaust ports 632. The air blown out through the second air exhaust ports 632 of the second sirocco fans 63 cools the sheet stacking tray 10A2 and an upper surface of the sheets stacked on the sheet stacking tray 10A2. It is noted that in FIG. 3, an air movement path of air that flows from the duct 64 to the second air intake ports 631 of the second sirocco fans 63, and an air movement path of air blown out from the second air exhaust ports 632 of the second sirocco fans 63, are indicated by a thick arrow line.

It is noted that the number of the second sirocco fans 63 may be one or three or more.

The duct 64 is disposed above the discharge-near portion 33C to extend in the front-rear direction D2, and communicates with an air intake opening 10D (see FIG. 4) and the second sirocco fans 63, wherein the air intake opening 10D is formed in a front surface of the housing 10. It is noted that the front-rear direction D2 is perpendicular to the sheet conveyance direction D4 and is an example of a width direction of the present disclosure. In addition, the front side of the housing 10 is an example of an outer surface of an image forming apparatus of the present disclosure.

The provision of the duct 64 makes it possible to cool the sheet receiving portion 10A by using air from outside the housing 10. As a result, compared to a configuration where the sheet receiving portion 10A is cooled by using air inside the housing 10, it is possible to improve an effect of cooling the sheet receiving portion 10A.

It is noted that the air intake opening 10D may be provided in both the front side and the rear side of the housing 10. In this case, the duct 64 may be formed to communicate with both the air intake openings 10D provided in the front side and the rear side of the housing 10, and the second sirocco fans 63.

As shown in FIG. 3 and FIG. 5, the duct 64 includes a conveyance guide member 64A (an example of a bottom plate of the present disclosure) and a conveyance guide member 64B.

The conveyance guide member 64A constitutes a lower portion (bottom portion) of the duct 64. The conveyance guide member 64A forms a lower surface of the duct 64, and serves as an upper-surface sheet guide that guides an upper surface of a sheet that passes through the discharge-near portion 33C. The conveyance guide member 64A extends in the front-rear direction D2. The conveyance guide member 64A has an opening 64C (see FIG. 5) that is opened downward at a center in the front-rear direction D2.

The conveyance guide member 64B constitutes an upper portion of the duct 64. The conveyance guide member 64B forms an upper surface of the duct 64, and serves as a lower-surface sheet guide that guides a lower surface of a sheet that is conveyed in the third conveyance path 40. The conveyance guide member 64B extends in the front-rear direction D2.

Among the pair of first discharge rollers 35, the upper discharge roller 35A is rotatably supported by the conveyance guide member 64A. As shown in FIG. 5, a rotation shaft 35A1 of the upper discharge roller 35A is stored in the duct 64, and a part of a lower portion of the upper discharge roller 35A is exposed from the opening 64C to the discharge-near portion 33C.

As shown in FIG. 5, the seal member 65 seals gaps formed between the opening 64C of the conveyance guide member 64A and the upper discharge roller 35A. For example, the seal member 65 is a resin-made film, an end portion thereof in the sheet conveyance direction D4 is fixed to an outer edge portion of the opening 64C, and the other end portion thereof faces an outer circumferential surface of the upper discharge roller 35A across a predetermined interval. The seal member 65 prevents air heated by the fixing portion 50 from flowing into the duct 64 through the gaps formed between the opening 64C and the upper discharge roller 35A. It is noted that the seal member 65 may be provided in contact with the outer circumferential surface of the upper discharge roller 35A.

It is noted that the cooling portion 60 may not include the seal member 65. In addition, the duct 64 may be disposed by avoiding the pair of first discharge rollers 35. In addition, the conveyance guide member 64A may not serve as the upper surface sheet guide that guides the upper surface of a sheet passing through the discharge-near portion 33C. In addition, the cooling portion 60 may not include the duct 64.

As described above, in the image forming apparatus 100, the first sirocco fans 61 cool the lower surface of a sheet that passes through the discharge-near portion 33C, and the second sirocco fans 63 cool the sheet receiving portion 10A. As a result, compared to a configuration where air blown to a surface of a sheet is used to cool the sheet receiving portion 10A, it is possible to improve an effect of cooling the sheet receiving portion 10A. Accordingly, it is possible to prevent sheets with toner images fixed thereto from sticking together on the sheet receiving portion 10A.

In addition, in the image forming apparatus 100, the first sirocco fans 61 and the second sirocco fans 63 are used to cool: a sheet passing through the discharge-near portion 33C; and the sheet receiving portion 10A. As a result, compared to a configuration where an axial fan is used to cool a sheet passing through the discharge-near portion 33C and cool the sheet receiving portion 10A, it is possible to decrease the space in which the cooling portion 60 is provided.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a sheet discharge device comprising:

a discharge conveyance path that communicates with a discharge port through which a sheet having passed through a fixing portion is discharged, the sheet having a toner image transferred thereon and heated in the fixing portion;

a pair of discharge rollers configured to convey the sheet along the discharge conveyance path and discharge the sheet from the discharge port;

a side wall extending downward from the discharge port;

a sheet stacking tray extending from the side wall in a sheet discharge direction in which the sheet is discharged by the pair of discharge rollers, the sheet stacking tray allowing the sheet discharged from the discharge port to be stacked thereon;

a first fan disposed below the discharge conveyance path and configured to blow air toward the discharge conveyance path; and a second fan disposed above the discharge port and configured to blow air from above the discharge port toward the sheet stacking tray;

a housing;

a sheet supply portion configured to supply the sheet;

an image forming portion located in the housing and configured to form a toner image on the sheet supplied from the sheet supply portion;

the fixing portion located upstream of the sheet discharge device in the housing;

a ventilation path formed below the side wall in the housing; and a communication port formed on a lower surface of the discharge conveyance path, wherein the first fan includes:

a first air intake port configured to take in air; and a first air exhaust port configured to exhaust air, the first fan is disposed inside the side wall such that the first air intake port communicates with the ventilation path and the first air exhaust port faces the communication port, and the first fan takes in air from an air supply portion provided to extend in the sheet discharge direction below the sheet stacking tray, via the ventilation path and the first air intake port, and blows air to the discharge conveyance path via the first air exhaust port and the communication port.

2. The image forming apparatus according to claim 1, further comprising:

a duct disposed above the discharge conveyance path to extend in a width direction perpendicular to a sheet conveyance direction, the duct communicating with an air intake opening formed in an outer surface of the housing, and communicating with the second fan, wherein the second fan includes:

a second air intake port communicating with the air intake opening via the duct to take in air from the air intake opening; and a second air exhaust port configured to exhaust air, the second fan takes in air from the second air intake port, and blows air to the sheet stacking tray via the second air exhaust port.

3. The image forming apparatus according to claim 2, wherein the duct includes a bottom plate that forms a lower surface of the duct, and the bottom plate is configured to form an upper surface of the discharge conveyance path, and serves as an upper-surface sheet guide that guides an upper surface of the sheet that passes through the discharge conveyance path.

4. The image forming apparatus according to claim 3, wherein the pair of discharge rollers include an upper discharge roller and a lower discharge roller, the upper discharge roller being disposed at an upper position, the lower discharge roller being disposed at a lower position, an opening is formed in the bottom plate of the duct, a rotation shaft of the upper discharge roller is stored in the duct, and a part of a lower portion of the upper discharge roller is exposed from the opening to the discharge conveyance path, and a seal member is attached to an edge portion of the opening, the seal member sealing a gap formed between the opening and the upper discharge roller in the sheet conveyance direction.

5. An image forming apparatus comprising:

a sheet discharge device that includes:

a discharge conveyance path that communicates with a discharge port through which a sheet having passed through a fixing portion is discharged, the sheet having a toner image transferred thereon and heated in the fixing portion;

a pair of discharge rollers configured to convey the sheet along the discharge conveyance path and discharge the sheet from the discharge port;

a side wall extending downward from the discharge port;

a sheet stacking tray extending from the side wall in a sheet discharge direction in which the sheet is discharged by the pair of discharge rollers, the sheet stacking tray allowing the sheet discharged from the discharge port to be stacked thereon;

a first fan disposed below the discharge conveyance path and configured to blow air toward the discharge conveyance path; and a second fan disposed above the discharge port and configured to blow air from above the discharge port toward the sheet stacking tray;

a housing;

a sheet supply portion configured to supply the sheet;

an image forming portion located in the housing and configured to form a toner image on the sheet supplied from the sheet supply portion;

the fixing portion located upstream of the sheet discharge device in the housing; and a duct disposed above the discharge conveyance path to extend in a width direction perpendicular to a sheet conveyance direction, the duct communicating with an air intake opening formed in an outer surface of the housing, and communicating with the second fan, wherein the second fan includes:

a second air intake port communicating with the air intake opening via the duct to take in air from the air intake opening; and a second air exhaust port configured to exhaust air, the second fan takes in air from the second air intake port, and blows air to the sheet stacking tray via the second air exhaust port, the duct includes a bottom plate that forms a lower surface of the duct, and the bottom plate is configured to form an upper surface of the discharge conveyance path, and serves as an upper-surface sheet guide that guides an upper surface of the sheet that passes through the discharge conveyance path.

6. The image forming apparatus according to claim 5, wherein the pair of discharge rollers include an upper discharge roller and a lower discharge roller, the upper discharge roller being disposed at an upper position, the lower discharge roller being disposed at a lower position, an opening is formed in the bottom plate of the duct, a rotation shaft of the upper discharge roller is stored in the duct, and a part of a lower portion of the upper discharge roller is exposed from the opening to the discharge conveyance path, and a seal member is attached to an edge portion of the opening, the seal member sealing a gap formed between the opening and the upper discharge roller in the sheet conveyance direction.

* * * * *